US009051071B2

(12) United States Patent
Perl et al.

(10) Patent No.: US 9,051,071 B2
(45) Date of Patent: Jun. 9, 2015

(54) DEVICE AND METHOD FOR MANUFACTURING STRAPPED PACKS AND REGULATORY AND/OR CONTROL METHOD FOR A STRAPPING DEVICE

(75) Inventors: Kurt Perl, Rimsting (DE); Michael Hartl, Raubling (DE); Christian Napravnik, Rosenheim (DE)

(73) Assignee: Krones AG, Neutraubling (DE)

( * ) Notice: Subject to any disclaimer, the term of this patent is extended or adjusted under 35 U.S.C. 154(b) by 700 days.

(21) Appl. No.: 13/366,978

(22) Filed: Feb. 6, 2012

(65) Prior Publication Data

US 2012/0210674 A1 Aug. 23, 2012

(30) Foreign Application Priority Data

Feb. 17, 2011 (DE) ..... 10 2011 011 627

(51) Int. Cl.

| | |
|---|---|
| ***B65B 13/02*** | (2006.01) |
| ***B65B 13/22*** | (2006.01) |
| ***B65B 27/04*** | (2006.01) |
| ***B65B 65/00*** | (2006.01) |

(52) U.S. Cl.

CPC ..... *B65B 13/22* (2013.01); *B65B 27/04* (2013.01); *B65B 65/006* (2013.01)

(58) Field of Classification Search

CPC ..... B65B 13/22; B65B 21/00; B65B 27/04; B65B 65/006

USPC ..... 53/398, 399, 589, 48.1–48.4, 493, 503, 53/64, 66, 74, 396; 100/2, 4, 26, 29, 32, 100/33 PB

See application file for complete search history.

(56) References Cited

U.S. PATENT DOCUMENTS

| | | | | |
|---|---|---|---|---|
| 3,330,408 | A | 7/1967 | Wanderer | |
| 5,078,058 | A | 1/1992 | Schwede et al. | 100/32 |
| 5,615,538 | A | 4/1997 | Miyashita et al. | 53/589 |
| 5,775,486 | A | 7/1998 | Edqvist | 206/145 |
| 5,791,238 | A | 8/1998 | Garbotz | 100/32 |
| 5,894,789 | A | 4/1999 | Huber | 100/4 |
| 6,003,438 | A | 12/1999 | Schwede | 100/4 |
| 6,038,967 | A | 3/2000 | Chak et al. | 100/2 |
| 6,708,606 | B1 | 3/2004 | Bell, Jr. et al. | |
| 6,931,986 | B1 | 8/2005 | Liu et al. | 100/4 |

(Continued)

FOREIGN PATENT DOCUMENTS

| | | |
|---|---|---|
| CN | 1498822 | 5/2004 |
| CN | 201411058 | 2/2010 |

(Continued)

*Primary Examiner* — Stephen F Gerrity
*Assistant Examiner* — Joy N Sanders
(74) *Attorney, Agent, or Firm* — Davidson, Davidson & Kappel, LLC

(57) ABSTRACT

A device and method for the manufacturing of a pack including at least one article. The device includes a strapper for strapping a strip around the at least one article. The strapping is strapped around the outside of the article horizontally and/or vertically and/or cross-wise. A device generates a definable tensioning force of the strapping. A detector for the detection of properties of the article(s) is coupled and/or effectively connected to the device for generating a definable tensioning force of the strapping. A regulation and/or control method for a strapping device is also provided. Recorded properties of the articles to be wrapped and/or of the strapping material to be used are used as control values for the tensioning force and/or back tensioning force.

16 Claims, 10 Drawing Sheets

(56) References Cited

U.S. PATENT DOCUMENTS

| | | | | |
|---|---|---|---|---|
| 7,428,866 | B2 | 9/2008 | Reiche | 100/4 |
| 2006/0186258 | A1 | 8/2006 | Ubertini | 242/564 |
| 2007/0157555 | A1* | 7/2007 | Tanner | 53/399 |
| 2011/0056392 | A1 | 3/2011 | Neeser et al. | |

FOREIGN PATENT DOCUMENTS

| | | | |
|---|---|---|---|
| DE | 1 457 489 | A | 11/1971 |
| DE | 3 933 756 | A1 | 4/1991 |
| DE | 4 425 908 | C2 | 1/1995 |
| DE | 195 23 274 | A1 | 1/1997 |
| DE | 196 02 579 | A1 | 7/1997 |
| DE | 197 22 066 | A1 | 12/1998 |
| DE | 697 10 354 | T2 | 3/2003 |
| DE | 20 2004 016 951 | U1 | 1/2005 |
| DE | 10 2004 012 733 | B4 | 10/2005 |
| DE | 20 2006 000 215 | U1 | 3/2006 |
| DE | 60 2004 006 125 | T2 | 8/2007 |
| DE | 10 2009 004 480 | B3 | 7/2010 |
| EP | 0 806 349 | B1 | 11/1997 |
| EP | 2 206 650 | A1 | 7/2010 |
| JP | 633 07 008 | A | 12/1988 |
| JP | 5 229 507 | A | 9/1993 |
| JP | 9 240 617 | A | 9/1997 |
| JP | 112 78 424 | A | 10/1999 |
| JP | 2006182449 | A | 7/2006 |

* cited by examiner

DEVICE AND METHOD FOR MANUFACTURING STRAPPED PACKS AND REGULATORY AND/OR CONTROL METHOD FOR A STRAPPING DEVICE

This claims the benefit of German Patent Application DE 10 2011 011 627.3, filed Feb. 17, 2011 and hereby incorporated by reference herein.

The present invention relates to a device for the manufacturing of strapped packs and a corresponding method. Furthermore, the invention relates to a regulatory and/or control method for a strapping device.

BACKGROUND

Different types of packaging are available for the processing, compilation, arrangement and packaging of products such as beverage containers. For instance the articles or containers are combined into portable, relatively handy container units or packs. To combine individual articles into larger packs different ways are known. Beverage containers are combined and packaged into packs comprising four, six or more containers. The generation or manufacturing of such packs is usually unavoidable, because they are the most common type of sale units used for selling beverage containers or bottles made of PET plastic. For transportation several packs are usually combined again and/or assembled in layers and palletized.

In the production of commonly known packs, specific manufacturing steps are required to process the film that is normally used for the shrinking process. These manufacturing steps require a relatively high energy use. The used film causes high costs during manufacturing, provision and handling. After the packs comprising the beverage containers etc. are sold, the used film is not required any longer. Still it causes additional disposal costs. Also, the required machinery like the so-called film-wrapping device and other handling modules, which are required for the manufacturing of these shrink packs, causes high investment costs. Finally, also the provision of the so-called shrinking tunnel requires a relatively high capital investment. In the shrinking tunnel the film, which has been wrapped around the containers, is shrunk around the containers with the use of hot air.

Packs, whereby the containers are held together by at least one strapping, are called strapped packs. These strapped packs do not require the use of shrinking film. The containers are combined and connected into packs with the help of so called strapping strips. The containers, bottles or articles are grouped into formations in continuously or intermittently working strapping devices. These formations are then strapped with one or several strips by a strapping module. Thereby formations of 1×2-arrangements (two containers in a row), 2×2-arrangements (four containers arranged in a squared formation or a diamond shaped formation), 3×2-arrangements, 4×3-arrangements or basically any variable nxm-arrangement can be generated. Stability problems may arise when strapping strips are used for combining containers in packs. Under certain circumstances the containers are not in a stable position to each other. This is mostly due to an unclear assignment of the containers in relation to each other. Usually certain pre-stress forces of the at least one strapping are required to reduce the movement of the containers against each other.

In the beverage industry flexible plastic bottles are preferentially used. Problems may arise due to different internal pressures inside these flexible articles and containers. Many beverage containers are supplemented with carbon dioxide, nitrogen or other gases or substances during filling. The internal pressure of the containers, which are to be connected by a strapping, is not constant but changes depending on different conditions. The internal pressure especially depends on the temperature conditions during the filling process, especially the outer or surrounding temperature. The internal pressure also depends on the concentration of the gas or carbon dioxide in the solution; the time elapsed since the filling and numerous other parameters such as the machine hall temperature, the temperature of the decanted liquid, the season etc. Since the parameters for the strapping process and the pre-stress forces applied during the strapping process have to be set to a specific value, this can easily lead to an excessive or inadequate pre-stress. If the applied pre-stress is too high, the containers can be damaged easily. If the applied pre-stress is too low, the stability of the pack can be impaired. Whether the chosen pre-stress is set correctly for the strapping can essentially only be verified by an extraction and examination of samples. However, this method produces defective containers and packs, which have to be discarded. The parameters for the strapping device have to be set and re-adjusted by an operator.

DE 20 2006 000 215 UI shows a pack that comprises goods and includes a packaging material strapped around the goods. The packaging material is a continuous strip of packaging material. The two ends of the packaging material form an overlapping region. The packing strip is wrapped around the goods, whereby an overlapping region is formed by the two ends. The thus-formed packaging material sections are adhesively attached to the goods by cohesive forces. It is proposed that an adhesive strip is attached on an outer surface of a free end of the strip-shaped packaging material, thereby forming a self-adhesive free end of the packaging material. In this embodiment of a pack, the containers can move in their formation and do not remain stable in the pack.

A pack made from several bottles is described in DE 1 457 489 A. The bottles are held together in the shape of a packaging unit using endless strips. A handle allows the carrying of the package. A further pack arrangement is shown in U.S. Pat. No. 5,775,486 A. Rows of three or six bottles or cans are secured by top-parts made from cardboard and combined into larger packs by means of strapping strips.

SUMMARY OF THE INVENTION

It is an object of the present invention to provide an improved device and a respective method for producing strapped packs comprising one, but in particular comprising at least two articles or containers, which are combined by a strapping. The improved device and respective method should help to prevent damages due to too high pre-stress on the pack. The device and method shall also prevent instabilities of the manufactured pack due to inadequate pre-stress. Especially a device and a corresponding method should be provided, where an optimized tensioning force of the strapping can be guaranteed even with changing ambient conditions and product parameters, without this being associated with a production of a higher amount of defective packs. Furthermore, a regulatory and/or control method for a strapping device is provided, which allows an optimized control of the tensioning force of the strapping.

The present invention provides a device for manufacturing a pack. The present invention further provides a device for manufacturing a pack comprising at least one article. The device comprises at least one strapping device for the application of at least one strapping to the at least one article. The strapping is ribbon-like or strip-like and is placed and/or strapped around the outside of the article(s) horizontally and/ or vertically and/or in a cross over manner. The device furthermore comprises a device for generating a definable tensioning force of the strapping. The device according to the invention is characterized by a detection means for detecting certain properties of the article(s). The detection means is coupled and/or operationally connected to a device for generating a definable tensioning force of the strapping. This coupling or effective connection is especially accomplished by regulation and/or control technology. The detection means for detecting article properties can, for instance, comprise sensory means or measuring means as will be described in the following exemplary embodiments.

However, an input terminal for the manual entry of article parameters and/or article properties can be used instead of a detection means for detecting article properties. The detection means may for example be formed by a bar code reader or another code reader, an optical sensor or the like, which can be used to initialize the strip tension control or which can be used to initialize the device for generating a definable tensioning force of the strapping. Such a manual or machine-assisted initialization can be used sensibly, when different properties can be assigned to the different articles that are to be strapped, whereby the different mechanical properties of the articles are essentially already known. It is conceivable, for example, that a product color, a beverage color, a container shape, etc., each provides an input value to initialize the device for generating the tensioning force. The respective control data is preferably stored in a database.

The device according to the invention can comprise means for the fixation of strapping ends. The device can furthermore comprise means for the formation of at least one loop. The loop is preferentially formed in the section of at least one part of the strapping that is to be connected or that has been connected already. Such a loop can serve to improve the handling of the strapping; especially it can improve the opening of the strapping strip. When the strapping is either cut or opened at a defined separation spot, the loop can prevent a whip-like opening of the strapping.

In terms of signal processing, the detection means for detecting the properties of the article(s) is preferentially located upstream of the strapping device. Of course, the two units (the detection means and the strapping device) can be structurally integrated or united in a common control circuit. Nevertheless it is useful to measure, to detect or to enter manually and/or automatically the article properties first in any meaningful way, before a regulatory signal and/or a control signal is generated for the strapping device and especially before a regulatory signal and/or a control signal is generated for the device for generating the tensioning force on the strapping.

The pack, which is to be strapped by the device according to the invention, comprises at least one article. Usually such a pack comprises at least two articles, which are first placed beside each other and then grouped together. The grouped articles are then tightly connected by the strapping. The device according to the invention can comprise a device for wrapping or strapping the article or the at least two articles with a strapping. Thereby a ribbon-like or strip-like strapping is used, which is placed and or wrapped around the outside of the articles horizontally and/or vertically and/or diagonally or crosswise. The strapping is either closed or the ends of the strapping are interconnected. Furthermore, a means for the fixation of overlapping or abutting ends of the strapping and/or for the formation of a loop, which is to be formed in at least one section of the closed strapping, may be provided. A defined tensioning of the strapping strip or a defined tensioning force is generated or applied during the wrapping and fixation of the strapping around the articles. This is done by a suitable device or machine equipment. The tensioning force or tensioning of the strapping strip can be described as being part of an externally applied pre-stress of the strapping. Such a pre-stress of the strapping or tensioning of the strapping strip is essential for the mechanical integrity of such packaging arrangements. Otherwise the articles are not held together with the required stability. If the pre-stress or tensioning of the strapping strip is too low, the individual articles in the pack tend to slip or even fall out. If the pre-stress or tensioning of the strapping strip is too high, there is a risk of excessive deformation or constriction of the articles, which can lead to damage of the articles. Therefore a defined tensioning of the strapping strip must be applied during the manufacturing of the pack or during the fixation of the ends of the strapping or during the fixation of the loop (if the strapping is closed).

According to the present invention the pre-stress of the fixed strapping or the strapping to be fixed (which is also called tensioning of the strapping strip or tensioning force) can be adjusted variably. The invention furthermore relates to a respective method for the manufacturing of packs comprising at least one article. The packs are formed and/or held together by at least one ribbon-like or strip-like strapping, which is placed and/or strapped around the outside of the article(s) horizontally and/or vertically and/or cross wise. The method for the formation of packs according to the invention is essentially characterized in that the tensioning force of the strapping can be controlled and/or regulated individually and variably, depending on the properties of the articles. The tensioning force of the strapping can be variably controlled and/or regulated, particularly in the light of the recorded mechanical properties of the articles. The variable control and/or regulation can especially be adjusted according to parameters related to the strength and/or filling level and/or internal pressure of the articles. Furthermore it can be provided that the ends of the strapping are interconnected after the required tensioning force of the strapping has been applied. The connection can for instance be done by welding and/or bonding or sticking the ends together. Alternatively or additionally it can be provided, that the ends of the strapping are interconnected after the required tensioning force of the strapping has been applied, whereby a loop is formed simultaneously. The method for the manufacturing and strapping of packs according to the invention provides that certain properties of the article(s) are detected and/or recorded. The respective signals are then transferred to a device for generating a defined tensioning force of the strapping. The signals are for instance control variables or control signals. The required coupling of the detection of the article properties or the corresponding signal data connection is particularly done by control technology and/or regulatory technology. According to one inventive embodiment the detection means for detecting product properties can comprise sensory means or measuring means. The detection of the article properties can optionally be done manually by entering article parameters and/or article properties. The article properties can also be transferred to the signal processing means with the help of bar codes, machine-readable codes on the product packaging and/or machine-readable codes on the lateral surfaces of articles or the like. The measured or manually recorded article properties initialize the control of the tensioning of the strapping strip or initialize the device for the generation of a defined tensioning force. Such a manual or machine-assisted initialization can be especially useful, when different, but essentially already known mechanical properties can be assigned to the different strapped articles. This has already been described above.

A variation of the method according to the invention serves for the manufacturing of packs that comprise at least one, especially two or more articles or containers, which are to be connected or combined. The articles or containers are held together by a ribbon-like or strip-like closed strapping or a strapping with interconnected ends. The at least one strapping is strapped around the outside of the articles or containers horizontally and/or vertically and/or diagonally or crosswise. The overlapping or abutting ends of the strapping are pre-stressed and fixed together. Alternatively and/or additionally the closed strapping is pre-stressed by forming a loop in at least one section of the strapping or whereby the strapping is provided with a strip tensioning. The device as well as the method according to the invention can optionally provide that the tensioning forces or strip tensioning of the strapping to be fixed or of the fixed strapping can be controlled and/or regulated individually and variably, depending on the mechanical properties of the articles or article parameters. The variable control and/or regulation of the tensioning force (pre-stress of the strapping or strip tensioning) can especially be adjusted according to parameters related to the strength of the articles and/or related to the filling level of the articles and/or related to the internal pressure of the articles.

Packs which are generated and processed according to the invention usually comprise at least two connected PET-containers or other articles or containers. The PET-containers are connected by at least one ribbon-like or strip-like closed strapping, which is horizontally strapped around the outside of the PET-containers. Optionally a handle can be attached to the containers and/or the strapping, whereby the handle spans over the top side of the pack. The handle may be fixed to the outer peripheral surfaces of two PET containers, which are arranged opposite each other, side by side or adjacent to each other. A common characteristic of such packs is the horizontal strapping, which is strapped around the outside of the PET-containers. The packs each comprise at least two, preferentially four, if necessary five, six, seven or more connected PET-containers. The strapping is ribbon-like or strip-like and keeps together the containers of a pack. The strapping is preferably wrapped around the PET containers during a continuous conveying process and then fixed to the containers. The PET-containers are not usually stopped or delayed during the application of the strapping, because the strapping can be applied in a continuous process during the continuous conveying of the PET-containers. One inner side section of the strapping, which is in contact with an outside of the PET containers, can be fixed tightly to one of the PET containers at a contact spot. At the contact spot the strapping may be fixed to the container by a particular material connection, especially by at least one welding joint. Such a connection prevents a movement of the PET containers against each other. Therefore a defined packing arrangement is maintained. Alternatively, however, this fixation may also be omitted. Then a shifting or movement of the containers against each other is possible, as has already been described above. In particular such a movement would still be possible after the application of a loop-like carrying handle. It further makes sense to apply the fixation of the strapping only after the determination of the final arrangement of the containers in the pack and after the application and proper placement of the carrying handle. Then the selected arrangement can be maintained reliably.

The internal pressure inside plastic bottles, PET-containers or the like, which have been filled with beverages or other liquids, can vary. This also changes the optimum strip tensioning that is required for the strapping. During the filling of beverages into containers, they are often supplied with carbon dioxide, nitrogen or other gases. Therefore the internal pressure inside the container varies with the filling temperature, the surrounding temperature, the solubility of carbon dioxide in the beverage, the time gone by since filling and other boundary conditions. These fluctuations cannot be calculated precisely, even when all of these boundary conditions are considered. Using the present invention, the pressure condition inside the container is taken into account, when the strapping is applied. If the internal pressure inside the container is rather low, damages to the containers because of too high tensioning forces of the strapping strip can be prevented reliably by a respective adjustment of the strip tension.

It should be noted, that the terms strip tensioning, tensioning of the strapping or pre-stress of the strapping used in the present context, in principle describe the resulting tension or effective strip tension. At least two counter-acting force components form the resulting tension or effective strip tension. On the one hand, the strapping is applied onto the pack with a certain tension. This tension is essential for the safe connection of the individual articles. On the other hand, the articles—which are more or less flexible and which are compressed by the strapping—apply a restoring force or returning tension on the strapping. This restoring force or returning tension counteracts the previously applied tensioning force of the strapping. The force resulting from these force components generates the effective strip tension of the manufactured pack. If, however, according to the independent claims the term "tensioning force" is used, is does not necessarily mean the resulting tension of the strapping. Instead it describes the tension force that is actually applied during the strapping process and fixation process (especially during welding or bonding of the overlapping ends of the strapping strip) by the strapping head or the strapping device and/or the device for generating the tensioning force or back tension for the strapping. After the strapping has been applied, the tensioning force counteracts the restoring force of the slightly deformed articles or containers. The sum of these forces generates the resulting strapping tension.

The optionally used welding connection can be produced as ultrasonic welding connection or laser weld or with any other suitable connection technique. If thermoplastics materials are used, the material must be melted or at least softened at the desired welding spot by supplying heat, in order to allow the formation of a material connection at the contact spot. During ultrasonic welding the plastic materials are connected by mechanical vibrations. The main feature of this method is that the heat required for welding occurs between the components by molecular and interfacial friction in and between the components.

The strapping is usually formed by at least one flat strip. The strip is strapped around the outsides of the at least one article of the pack or around the outsides of two or more PET-containers. The ends of the strip are then connected, while a defined strip tension is applied. The articles, items or PET-containers are combined into a pack with this strained strip-like or ribbon-like flat strapping. The articles, items or PET-containers can then be transported safely. With the present invention the essential tensioning of the strapping or strip tension is adjusted. Of course, the strapping can also be formed by two or more strips arranged in parallel. The strapping can thus be formed by one, two or more similar or different plastic strips or strips made from a composite material. The ends of the strips are overlapping or abutting and connected by gluing, welding, clamping, tying or interconnected otherwise. An advantageous embodiment may be formed by welding together the overlapping ends of the strapping. Moreover, it is also conceivable, that the ends are welded together and that the strapping is welded to at least one PET container of the pack at a welding spot. Thereby the PET container arrangement is secured during transport. Therefore the container of the pack cannot be displaced into different formations, for example they are not shifted from a longitudinal formation into a diagonal formation. In a pack, where the PET containers are arranged in a diagonal formation, it would be equally possible, that a first fixation spot is attached to a middle PET-container and a second fixation spot is attached to a PET container located diagonally opposite the middle PET-container. In this embodiment the containers in the pack cannot move into a longitudinal formation. The strapping is attached to the PET-containers by welding spots that do not allow any shifting of the containers. Preferably, the strapping should be fastened with at least one fixation spot to the pack compiled of PET-containers. If two fixation spots are used, it is especially sensible to place the two fixation spots on opposite PET-containers.

The PET-containers, which are combined in a pack, may each have an annular circumferential and/or horizontally extending recess for receiving and/or fixation of a strapping. Such a recess is especially suitable for further fixation of the strapping, because it fixes the horizontal position of the strapping. Furthermore, the PET containers held together in a pack each show a container neck below a top opening. For further fixation of the pack another strapping can be arranged in this container neck region. Each of these mentioned strapping variations can additionally be provided with at least one welding spot, whereby the welding spot is located on at least one PET container of the pack or whereby at least one PET container of the pack is provided with a welding spot during the manufacturing of the pack. Thereby a mutual displacement of the containers against each other can be prevented. Recyclable material can be advantageously used as strapping and/or as carrying handle. The recyclable material may consist of a single-grade thermoplastic etc. It may also be possible to use a biodegradable material. The recyclable and biodegradable material may optionally be used as a composite material in combination with thermoplastics and/or with fiber reinforcement. Regarding costs the invention has further advantages when compared to methods and/or devices known from prior art. The strapping strips as well as the carrying handles can be produced and processed cheaper than the commonly used packaging film, especially cheaper than shrinking film. No shrinking tunnel is required for the manufacturing of the packs, which largely reduces energy costs and furthermore reduces investment costs.

As has been mentioned above, the strip tension of the applied strapping can be adjusted variably, especially in consideration of mechanical strength properties of the articles. Especially filling level related article parameters and/or internal pressure related article parameters are taken into account. The strapping can be formed by one, two or more similar or different plastic strips or strips made of a composite material. The overlapping or abutting ends of the strapping strip are glued together, welded together, clamped together or connected in any other suitable way. The at least two articles are preferentially liquid containers, especially plastic beverage containers made from PET or the like.

If in the present context the terms mechanical strength or strength parameters or generally the term article parameters are used, they primarily refer to physical parameters like the internal pressure prevailing in the container or PET-container. The internal pressure can be derived from a detected deformation of the article. If an excess pressure prevails in the container, the side walls of the container bulge outward in a convex way. If a low pressure prevails in the container, the side walls of the container bulge inward in a concave way. Because of the typically used thin container walls, this convex or concave curvature can be recorded during the ongoing strapping process. Therefore the curvature of the container side walls can be used as a measure variable for the derivation of the internal pressure inside the container. However, it is also possible to detect the internal pressure prevailing in the container directly. The device may comprise an optical measuring device for detecting or deriving the internal pressure prevailing in the articles or containers. Such an optical measuring device may be provided for measuring a gas concentration of the gas space located above the filling level. The gas space is located in a section of the container directly beneath the container cap or bottle cap. Thus a concentration of the carbon dioxide content or the nitrogen content can be measured and the internal pressure in the container can be calculated from the measured values. Alternatively, the optical measuring device can also be used to detect and/or record a deformation, especially a concave or convex curvature of at least one side wall of the article.

The device according to the invention can optionally or additionally comprise a mechanical measuring means for measuring and/or recording the deformation or concave or convex curvature of at least one side wall of the article or container. Such a mechanical measuring means can comprise at least one sensing device, especially a tactile means or recipient means. The sensing device is able to detect a correlation between the curvature of at least one side wall of the article and the applied force. With a suitable mechanical arrangement a defined lateral force can be applied to the outer mantle surface of the container, whereby the resulting deformation is measured. From the measured deformation due to the introduction of the defined lateral force, the required pre-stress forces or tension forces for the strapping can be calculated. With such an arrangement, the absolute deformation resistance is measured, which is influenced by several factors. These influencing factors are, for example, the internal pressure inside the containers and the displacement back pressure of the liquid in the containers. The application of the lateral force and the measurement of the deformation can be done, for example, via a laterally arranged tactile button. The width of the tactile button preferentially corresponds to the width of a strapping. Furthermore the tactile button is preferentially height adjustable. Therefore it is possible to measure—as accurately as possible—in the position where the strapping strip is placed. Such a tactile button can be formed as a roll, which is unrolling from the container surface, grinding along the container surface or the tactile button can be designed as a selectively acting clocked pushing rod. If necessary, it may be sensible to use a tactile button comprising a conveying means. This guarantees that the containers are not delayed too much during measurement or detection or recording.

Such an arrangement provides a low-cost measurement variation, which can easily be used in multiple parallel conveyor lanes. It is advantageous that not the internal pressure is measured. Instead a defined force is applied to the container and the resulting deformation of the container is measured. Thereby the inherent rigidity of the container is taken into account. The optical properties and the overall material properties are not important for this measuring method. This measuring method does not work contact-free, but the susceptibility to contamination is still relatively low.

This measuring arrangement shows several special features. The measuring means or tactile means or scanner has to be adjusted according to any change in container format—i.e. container shape and/or container size. These adjustments can be done automatically, if necessary. Since it is not a contact-free system, braking or retardation effects can arise, which may lead to delays in the container transport. To avoid these undesirable effects, it might be useful to provide the measuring system with power driven rollers or a power driven endlessly circumferential traction means, such as a traction strip or the like. These rollers or traction means prevent a jamming and/or backing up the effect of the containers. The measuring method is not equally suited for any container shape and container geometry. This is due to the fact that it measures the effective deformation resistance of the container in one place and not the actual internal pressure inside the container. The suitability of this method may have to be determined by trial, especially for heavily contoured containers and/or for containers provided with grooves or constrictions and with non-circular cross-sections. Meanwhile the deformation of the container must be done by mechanical means; the evaluation of the measured displacement can be done contact-free, for example by means of optical, inductive and/or capacitive methods. Conclusions about the actual internal pressure can only be drawn with the aid of comparative measurements of unfumigated containers. This has to be considered during the evaluation of the recorded data.

According to another advantageous embodiment of the inventive device at least one of the detected article parameters from a recorded strip tension is derived during the wrapping and/or immediately prior to fixation of the strapping strip ends. A suitable measuring means may be assigned to the device. The measuring means should be able to measure the strip tension during the strapping process. The measuring means should furthermore be able to adjust the strip tension preferentially immediately prior to fixation or during fixation of the strapping strip ends. Thereby the strapping is preferentially adjusted in such a way that the optimal strip tension according to the respective states of the containers is produced.

The at least one detected or measured article parameter can advantageously be used as a control variable for a strip tension control. Thereby the strip tension can be adjusted during an ongoing process even with fluctuating article parameters, ie the strip tension can be adjusted according to different internal pressures inside the containers. A particular advantage of such a strip tension control is that the acquisition of the strip tension is not done retroactively. If a retroactive control was used, a high amount of defective packs would be produced. In the defective packs the strip tension would be either too high or too low. Instead the strip tension is adjusted already during the strapping process. Especially the strip tension is adjusted to suit the particular requirement of each strapped pack.

As has been mentioned already, the strip tension of the fixed strapping or the strapping to be fixed can be controlled variably with the described method for manufacturing packs. Thereby the detected mechanical article properties are considered, especially the internal filling level and/or the internal pressure. Preferentially at least one of the recorded article parameters is derived from a detected or measured deformation of the article or container and/or a measured internal pressure of the article or container. The internal pressure prevailing in the article or container and/or the deformation or concave or convex curvature of at least one side wall of the article or container can be detected or derived with an optical measuring means. In another advantageous embodiment of the inventive method a gas concentration in a section within the article or container can be measured and used to derive the internal pressure prevailing in the article or container. The gas concentration is especially measured in the gaseous space above the filling level of the article or container with the respective liquid or beverage.

Alternatively the deformation or concave or convex curvature of at least one side wall of the container can be detected or derived with a mechanical measuring means. It is also possible to derive at least one of the recorded article parameters from a recorded strip tension during the wrapping and/or immediately prior to fixation of the strapping strip ends. In this way, the at least one recorded article parameter can be advantageously used as a control variable for a strip tension control.

It should be mentioned at this point, that the present invention with all its aspects can principally also be applied to packs, whereby only one article, for example, a cargo box or the like, is provided with a strapping. This may be the case for shipping products, shipping cartons or the like. Such a carton may be wrapped in and stabilized with one or several parallel and/or cross-wise arranged strapping strips. The strapping strips can be arranged horizontally, vertically and/or diagonally or crossed. In principle, similar effects occur in such packs as have been described above. A strapping which is either too tight or too loose is also unfavorable in these cases. The present invention should also explicitly extend to such types of packs, whereby only one general cargo, one containers or one article is provided with a strapping. It is therefore defined that the two or more articles or containers referred to in the description and the claims may generally be replaced by a single article or container, without affecting or impairing the essential concept of the invention in any way.

The present invention also contains a general aspect of a regulatory and/or control method for a strapping device, in particular for the regulation of the tensioning force and/or the back tensioning force of the strapping device. In this method, the recorded properties of the articles and/or the used strapping material are used as control parameter for the tensioning force and/or back tensioning force. In particular, the signals of a detection means for detecting properties of the articles to be strapped are used for generating a control value for the strapping device in the novel regulatory and/or control method. With the regulatory and/or control method for a strapping device according to the invention a strapping head can be controlled advantageously. The strapping head may be part of a packaging system for packaging goods, packs of strapped articles, packs of containers or the like. Some of the corresponding processing parameters are adjustable through manual intervention or data entry in the strapping heads, which are currently employed for such purposes. But these strapping heads have no delay-free processing of variable recorded data. The recorded data may for instance allow a conclusion about the deformation properties and elastic properties of the containers. A respective adjustment or change of the tensioning forces applied during the strapping process would increase the processing quality as well as the product quality. The inventive regulation or control on the basis of the recorded, detected and/or measured article properties eliminates the drawbacks of the known strapping devices. The inventive regulation or control furthermore provides the possibility to produce an optimized strip tension of the strapping at any time. As has been mentioned already, the article properties can optionally be detected by sensory means or by other measuring means. The article properties can be processed in other ways as well. For example, an input terminal can be used for manual entry of article parameters and/or article properties. Additionally, initialization values for the strip tension control can be generated with the help of bar code readers or other code readers, optical sensors or the like. Such a manual or machine-assisted initialization can then be used sensibly, if different but essentially already known mechanical properties can be assigned to the different articles to be strapped, i.e. it is conceivable, that the color of an article, the color of a beverage, a container shape etc. each provide an input value for the initialization of the device for generating the tensioning force. The respective control data is preferably stored in a database.

BRIEF DESCRIPTION OF THE DRAWINGS

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1:
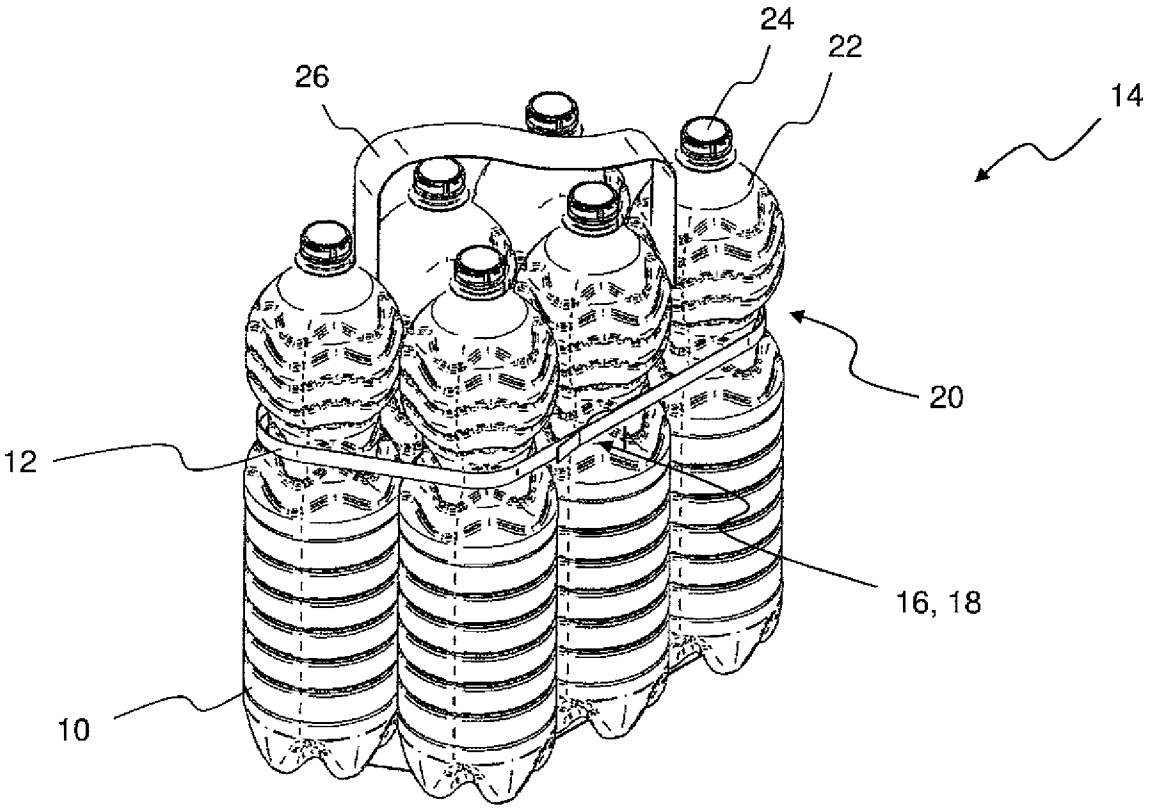
FIG. 1 shows a perspective view of a pack, whereby six beverage containers are combined by a strapping.

The same or equivalent elements of the invention are designated by identical reference characters in the FIGS. 1 to 12. Furthermore and for the sake of clarity, only the reference characters relevant for describing the respective figures are provided. It should be understood that the embodiments described are only examples of the device and method according to the invention, and they are not intended to limit the scope of the disclosure.

The schematic perspective view of FIG. 1 illustrates a possible embodiment of a strapped pack arrangement. Hereby six single beverage containers 10 are combined and fixed together in a 2×3 arrangement by a horizontal strapping 12, thereby forming a pack 14. The beverage containers 10 are made of a relatively thin PET plastic material (polyethylene terephthalate) or another suitable plastic material. In the illustrated embodiment, it is apparent that the containers 10 are moved in a diagonal direction against each other, whereby a so-called diagonal arrangement is formed. Due to the contact points between the containers 10, this diagonal arrangement is somewhat more stable than a rectangular arrangement.

The containers 10 show certain flexibility after filling and sealing. This is due to the properties of the material, especially due to the properties of the thin walled PET-plastics commonly used, the container geometries as well as possibly varying filling levels and possibly varying internal pressures. Therefore the strapping 12 should be applied with a defined strip tension and the overlapping ends of the strapping 12 have to be fixed. Otherwise there is the risk that the pack 14 is too loose and the container 10 could be moved and/or tilted against each other. On the other hand, the pre-stress of the strapping 12 or the strip tension should not be too strong, because then the flexible containers 10 could be deformed too much and may even be damaged. The flexibility of the container walls occurring during an ongoing operation depends on many parameters. The internal pressure prevailing in the container 10 has the greatest influence on the mechanical properties of the container 10. The present invention therefore relates to the measurement and adjustment of the pre-stress of the strapping or strip tension during the ongoing processing according to varying and possibly changing container parameters.

The overlapping ends 16 of a strapping strip 12 can be stuck together or joined in any suitable mechanical way. Normally the overlapping ends 16 are welded together to form a tight connection. A welding connection 18 is usually preferred over other joining methods. For instance ultra sonic welding, laser welding or other suitable joining techniques are used. When using a thermoplastic material as strapping strip material, the material at the designated welding spot is melted or at least softened by supplying heat and/or strong pressure. Thereby a material connection can be produced at the designated contact or welding spot. When using ultrasonic welding the plastics are connected by mechanical vibrations. The main feature of this method is, that the heat required for welding, is generated between the components by molecular and interfacial friction in the components.

The strapping 12 is formed by a flat strip, whereby the strip is strapped around the outsides of the PET-containers 10. According to the present invention a defined strip tension is adjusted and the ends 16 of the strapping 12 are subsequently interconnected. This strained, strip like or ribbon-like strapping 12 combines the PET-containers 10 into packs 14 and holds them together. In this arrangement the containers 10 can be transported safely. The defined outer contour of the pack 14 also allows the stacking and palletizing of a plurality of such packs 14. The strip tension of the strapping 12, which is indispensable for the cohesion and the shape of the pack 14, can be measured by means of the present invention and adapted to changing requirements. Two or more parallel strapping strips arranged at different heights can also form the strapping 12. The strapping 12 can thus be produced by one, two or more identical or different plastic strips or strips made of a composite material. The ends 16 of the strips are overlapping or abutting and are stuck together, welded together, clamped together, knotted together or joined in another way.

Figure 10:
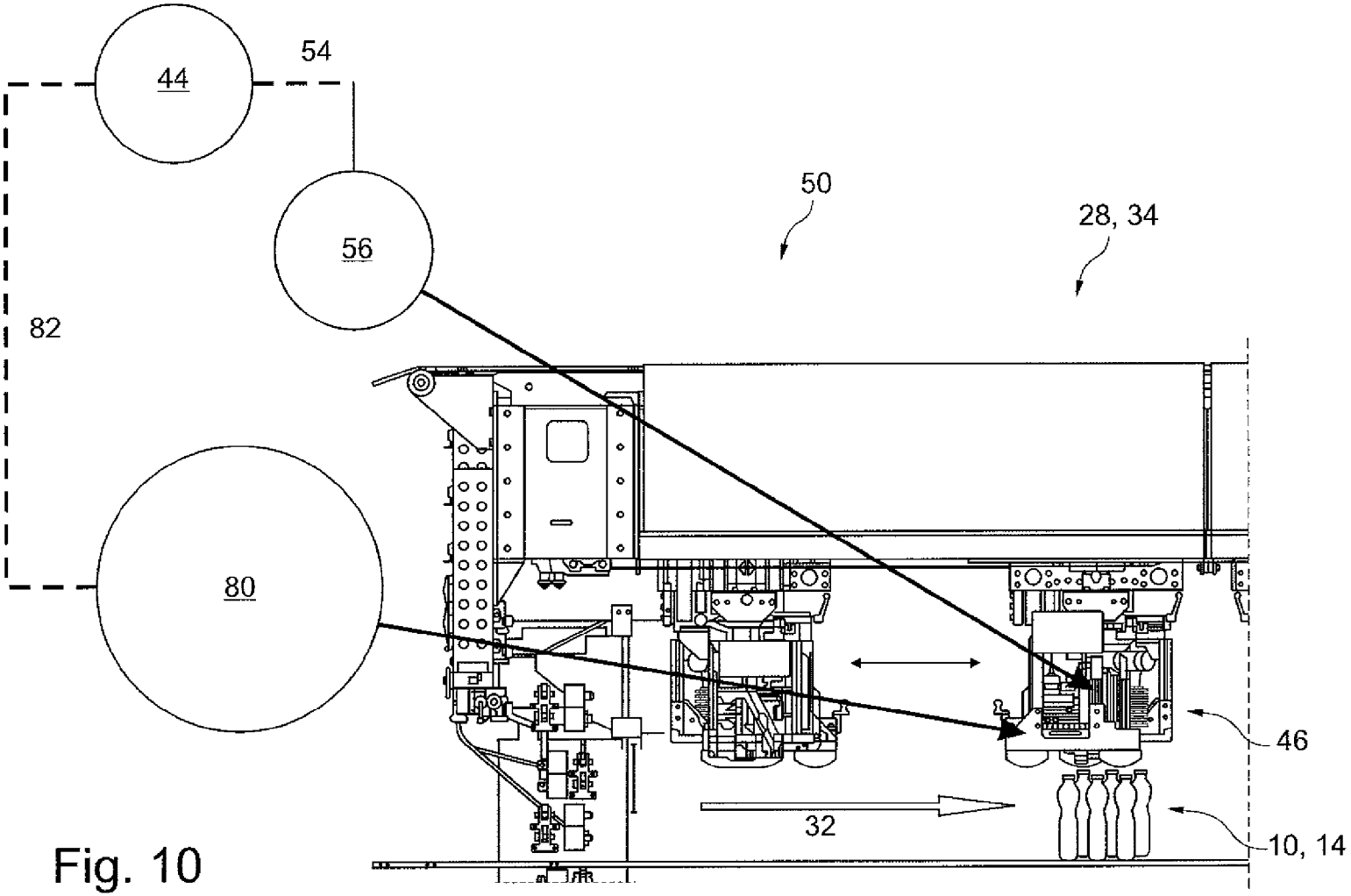
FIG. 10 shows a schematic view of a third embodiment of a control circuit for the recordation of the internal pressure of a container and adjustment of the pre-stress of the strapping.

The PET-containers 10, which are joined in a pack 14 according to FIG. 10, each show constrictions 20 in the upper third of their mantle surfaces. With such constrictions 20 an additional attachment of the strapping 12 can be formed, because the applied strapping 12 can be fixed advantageously in a horizontal position. Each of the PET-containers 10 joined in a pack 14 furthermore shows a top-side opening 24 and a bottle neck 22 below the top-side opening 24. Optionally a further strapping for the fixation of the PET-containers 10 can be assigned to these bottle neck 22 regions. Furthermore an optional carrying handle 26 made of a flexible material is attached to the strapping 12 and/or to the mantle surfaces of the containers 10. The pack 14 can be held and carried with the help of this carrying handle 26. When stacking several packs 14, the carrying handle 26 is pressed between the containers 10 so that the carrying handle 26 does not project above the pack 14. The flexible carrying handle 26 is only lifted for transport.

Figure 2:
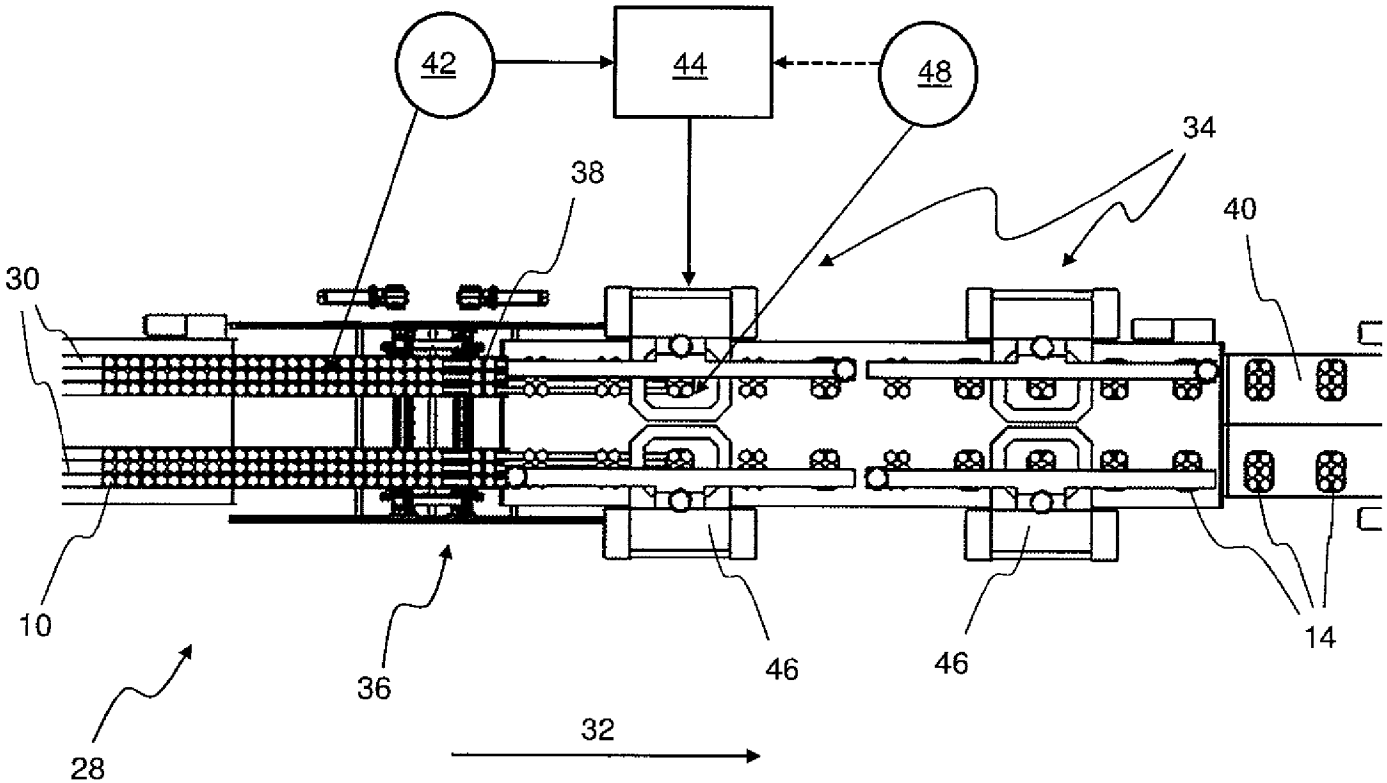
FIG. 2 shows a view of a conveying and packaging plant with a strapping module for the manufacturing of packs as seen from above.

FIG. 2 shows a schematic view of a part of a conveying and packaging plant 28 for containers 10 as seen from above. The conveying and packaging plant 28 comprises two parallel conveyors 30, which convey the containers 10 in a transport direction 32 to a strapping station 34, where the containers 10 are combined into packs 14. On each of the two parallel conveyors 30 the containers 10 are transported in three adjacent rows. In a grouping station 36 the containers 10 are subsequently grouped into pack formations 38 of 3×2 containers 10 each. In the region of the strapping station 34 (see FIG. 1) the pack formations 38 are provided with a strapping 12 and achieve the shape as shown in FIG. 1. After leaving the strapping station 34 on a further conveyor 40, the packs are subsequently transported to further packaging and/or palletizing stations.

The internal pressure prevailing in the containers 10 may be recorded already in the region of conveyors 30 via suitable optical measurers or optical measuring means 42. Thereby the pre-stress of the strapping or the strip tension can be adjusted to the recorded internal pressure of the container 10 in the region of the strapping station 34. The mechanical measurer or measuring means can also be arranged in the region of the conveyor 30. A laser measurer or measuring device can be used as optical measuring means 42. The optical measuring means 42 records the $CO_2$— or $N_2$— content in the container 10, especially in the section above the filling level. In this way the required strip tension can be calculated by a control and evaluation unit 44. Thereby the back tensioning force of closing units of strapping heads 46 can be adjusted, whereby the strip tension can be regulated in a desired and required manner.

Optionally or additionally the internal pressure prevailing in the containers 10 can be recorded by a suitable mechanical measurer or mechanical measuring means 48 in the region of the strapping station 34. The pre-stress of the strapping or the strip tension can be adjusted to the measured or derived internal pressure of the container 10 during the application of the strapping 12. The deformation of the container 10, which is measured with the mechanical measuring means 48, is taken as a basis for the calculation of the necessary strip tension by the control and evaluation unit 44. Subsequently the back tensioning force is adjusted by the closing units of the strapping heads 46 accordingly. The measurement can be done advantageously with the optical measuring means 42 and/or with the mechanical measuring means 48. The evaluation of the signals is done advantageously by the unit 44 and the control of the strapping heads 46 is carried out during the ongoing process of the conveying and packaging plant. Thereby the strip tension is permanently adjusted, especially to parameters of the containers 10 forming the pack 14 and influencing the back tensioning forces The strapping force and the strip back tensioning force are adjusted permanently and in real time, whereby the measured values or the values of the container strength derived from the measurement values taken by the optical measuring means 42 and/or taken by the mechanical measuring means 48 are taken into account. Thereby a closed control circuit (see FIG. 3 and FIG. 4) is formed for the regulation of the strip tension. Thereby the varying input values regarding the container strength are taken into account. The input values vary with the adjustment of the strip tension.

A further embodiment, which is not shown in FIG. 2, can provide that pre-stress of the strapping 12 is measured permanently in the region of the strapping head 46 during the strapping process and/or during the fixation process. This permanent measurement can be done in addition to the measurements taken by the measuring means 42 and/or 48 or instead of the measurements taken by the measuring means 42 and/or 48. If the measured strip tension is too high, it can be reduced to a meaningful value. Or if the measured strip tension is too low, it can be increased to a meaningful value. The measurement of the strip tension during the ongoing process can be taken via suitable tension sensors, force sensors, strain gauge devices or the like.

Figure 3:
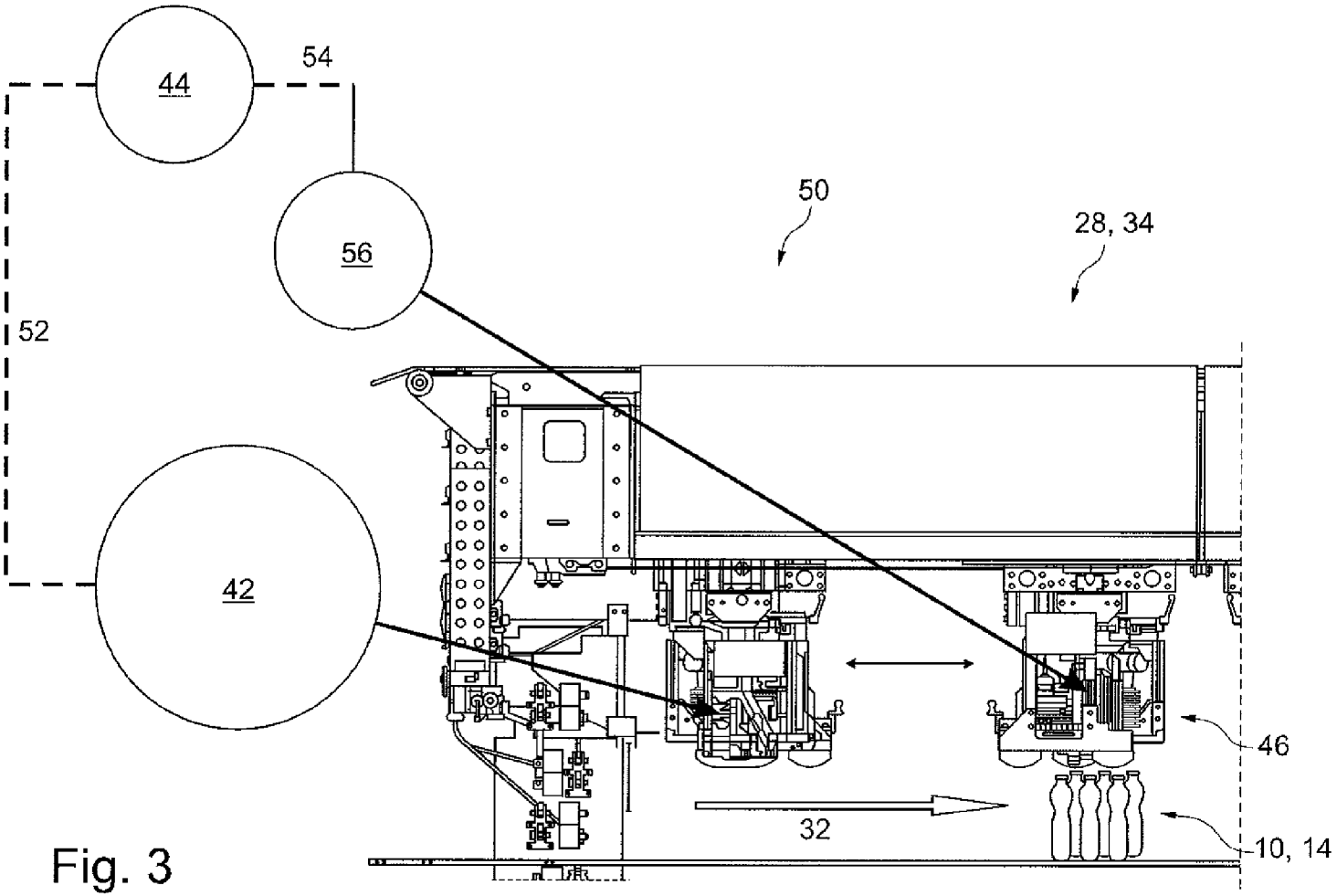
FIG. 3 shows a schematic view of a first embodiment of a control circuit for the recordation of the internal pressure of a container and adjustment of the pre-stress of the strapping.

FIG. 3 shows a schematic block diagram of an embodiment of a control circuit 50 for the adjustment of the strip tension of the strapping during the ongoing process of the conveying and packaging plant 28. The adjustment is done via a respective control of the strapping heads 46 of the strapping station 34 during the application and fixation of the strapping strips 12 around the pack 14. According to FIG. 3 a first embodiment is shown, whereby the internal pressure of the containers 10 combined in packs 14 is recorded via an optical measuring means 42. The output signals 52 of the optical measuring means 42 are transferred to the control and evaluation unit 44. The control and evaluation unit 44 then generates a control signal 54 and sends it to the back tensioning means or tensioner 56, which is located in the region of the strapping head 46. Thereby the pre-stress of the strapping strips 12 is regulated and adjusted to ensure the right strip tension according to the measured internal pressure.

As has been mentioned already, the optical measuring means 42 can optionally measure a gaseous concentration in the container 10. Alternatively it can measure a value in regard to the deformation of the container 10, for instance a tension course in one of the container walls, a reflecting behavior of the container mantle surfaces changing with the deformation or some other physical effect.

Figure 4:
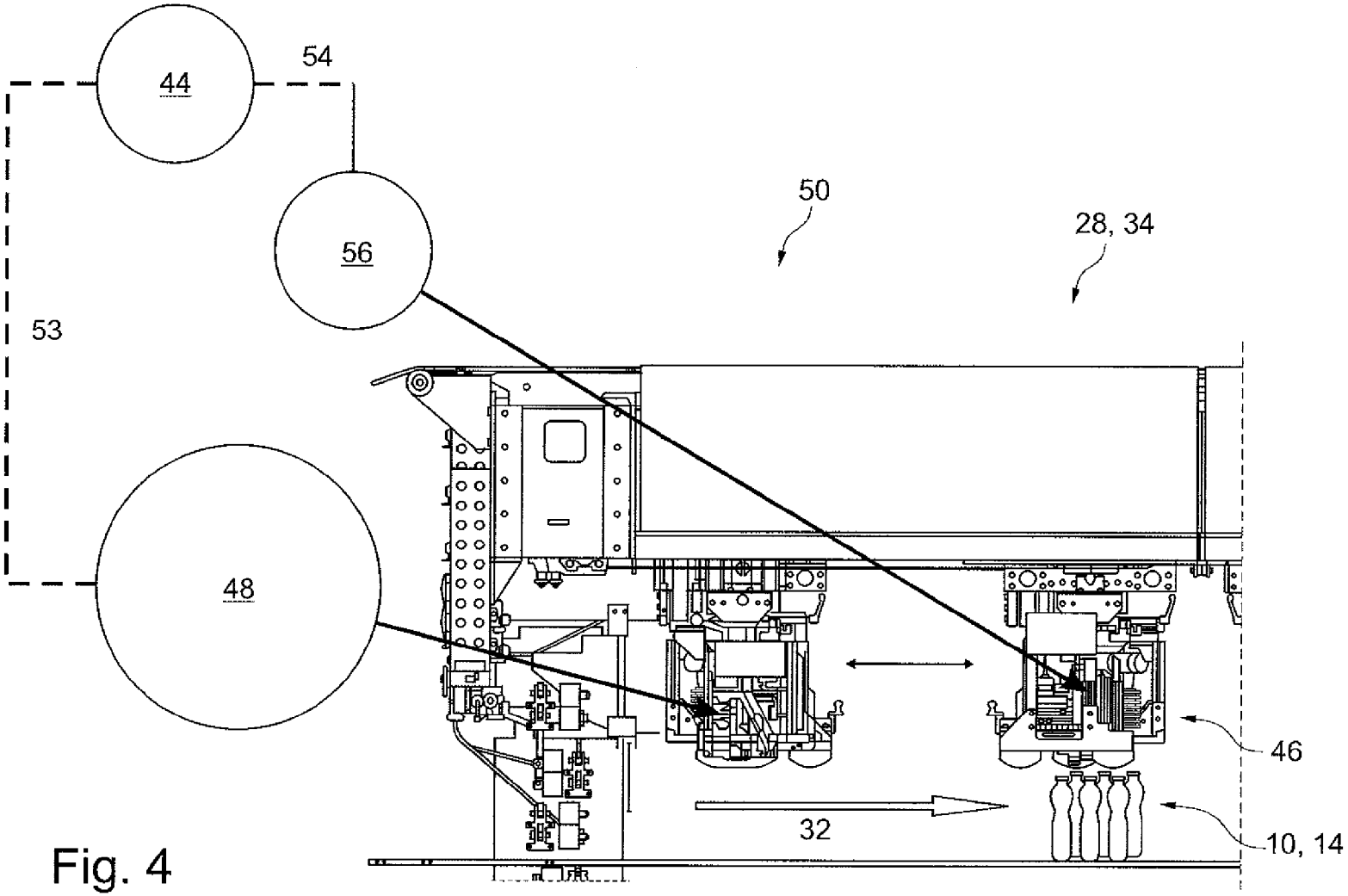
FIG. 4 shows a schematic view of a second embodiment of a control circuit for the recordation of the internal pressure of a container and adjustment of the pre-stress of the strapping.

FIG. 4 shows a schematic block diagram of an alternative embodiment of a control circuit 50 for the adjustment of the strip tension of the strapping 12 during the continuing process of the conveying and packaging plant 28. The adjustment is done via a respective control of the strapping heads 46 of the strapping station 34 during the application and fixation of the strapping strips 12 around containers 10 of the pack 14. According to FIG. 4 a second embodiment is shown, whereby the deformation behavior of the containers 10 is measured via mechanical measuring means 48. Thereby the internal pressure of the containers 10 is derived indirectly. The output signals 53 generated by the mechanical measuring means 48 are transferred to the control and evaluation unit 44. The control and evaluation unit 44 then generates a control signal 54 and sends it to the back tensioning means 56 located in the region of the strapping head 46. Thereby the strip tension of the strapping strips 12 is regulated and adjusted to ensure the right strip tension according to the measured internal pressure. The mechanical measuring means 48 can be designed as shown in the embodiments according to FIGS. 5 to 9. However, many other measuring arrangements, which are able to record significant values for the mechanical properties of the articles and/or provide significant values for the effective strip tension of the strapping strips 12, are also possible and can be used advantageously.

Figure 5:
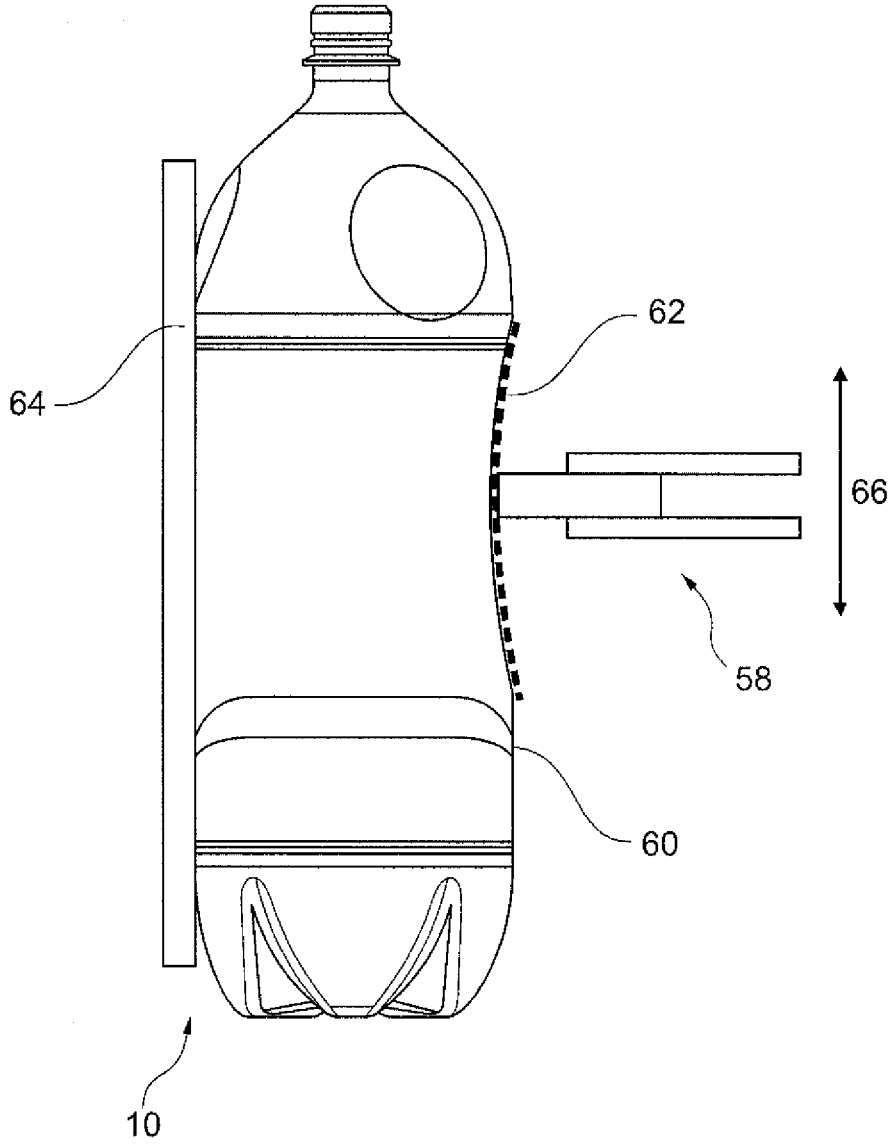
FIG. 5 shows a first embodiment of a mechanical measuring arrangement for the recordation of the container rigidity.

The schematic views of FIGS. 5 to 9 show examples of various embodiments of mechanical measuring means 48 for measuring the deformation behavior of the containers 10. From the recorded deformation behavior the internal pressure in the containers 10 can be derived. The schematic side view according to FIG. 5 shows a device and a method for the one-sided deformation of a liquid-filled plastic container 10. The container 10 is deformed by pressing a height-adjustable sensing element or sensor 58 onto its mantle surface 60, especially perpendicular to the mantle surface 60 or perpendicular to the longitudinal axis of the container 10. Thereby the deformation or deformation depth 62 resulting from a defined pushing force of the sensing element 58 is detected and measured. The recorded value is then used to derive the mechanical deformation properties of the container 10 and/or the internal pressure inside the container 10. The container 10 is supported against a rigid support wall 64, which is located opposite to the sensing element 58. The sensing element 58 includes height adjustment means or height adjuster 66 to accommodate different container shapes and/or container sizes. In this embodiment the sensing element 58 can be adjusted in height, parallel to the longitudinal axis of the container.

From the measured container deformation or deformation depth 62, the necessary tensioning force for the pack strapping is calculated. The illustrated arrangement records the absolute deformation resistance. The deformation resistance corresponds to the sum of the container rigidity, the container internal pressure and the displacement pressure of the liquid inside the container 10. The movement of the sensing element 58, which is almost perpendicular to the container mantle surface 60, may be accomplished in a number of ways. This is exemplified in FIGS. 7 to 9. Generally, other movements than the ones shown in the examples are also possible. The occurring forces provide a correlation between the deformation 62 and the necessary pushing forces and thus provide a value for the container rigidity or stiffness. The forces can be measured in different ways. For example inductive, optical, capacitive or mechanical measurement techniques can be used.

Figure 6:
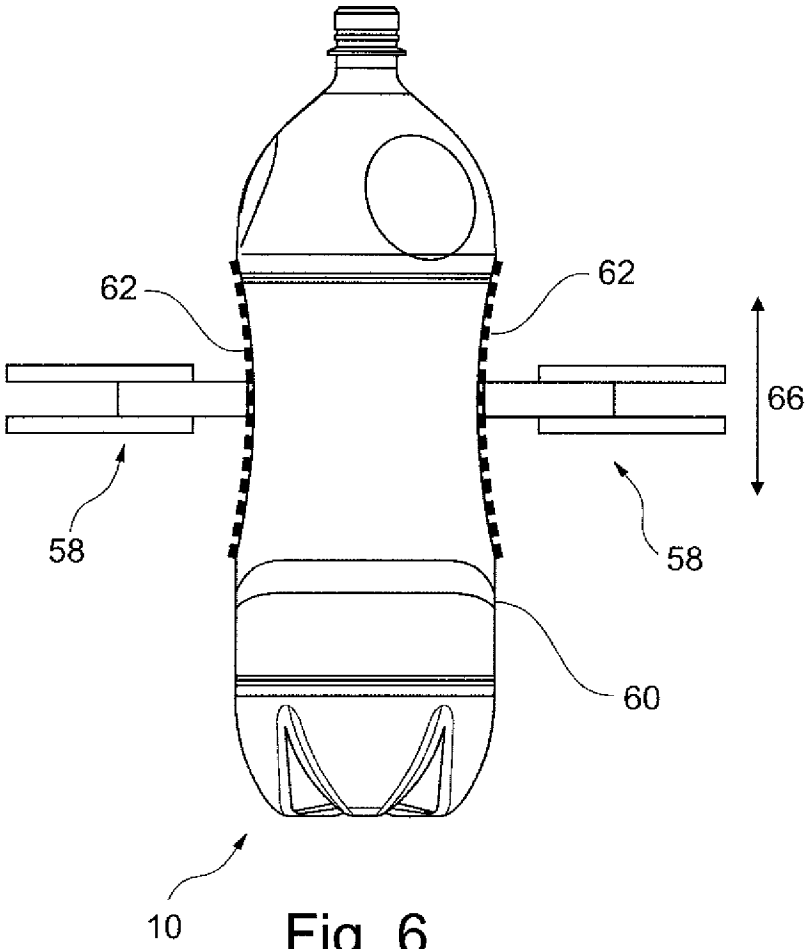
FIG. 6 shows a second embodiment of a mechanical measuring arrangement for the recordation of the container rigidity.

FIG. 6 shows a further mechanical measuring arrangement for the recordation of the deformation behavior of the containers 10. This mechanical measuring arrangement comprises two oppositely arranged sensing elements 58. These are pressed against the container mantle surface 60 in opposite directions, thereby normally leading to approximately symmetrical deformations 62 on opposite sides of the container 10. However, a non-symmetric deformation of the container 10 by the two sensing elements 58 usually provides no problem during evaluation of the recorded data. The evaluation unit calculates a mean value from the values taken for the different restoring forces. The mean value then provides the required value of the container rigidity.

The two sensing elements 58 of the measuring device according to FIG. 6 are also each height-adjustable in an appropriate manner (via height adjustment means 66). Therefore differently sized and/or differently shaped containers 10 can be processed. The sensing elements 58 according to FIG. 5 and FIG. 6 can either be unrolling from the container 10, grinding on the container 10 or designed with a clocked ram, which is acting punctually on the container 10.

Figure 7:
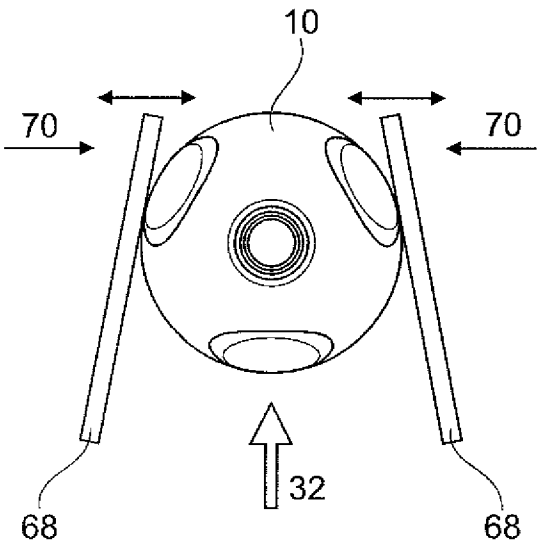
FIG. 7 shows a third embodiment of a mechanical measuring arrangement for the recordation of the container rigidity.

The top view of FIG. 7 shows an embodiment with grinding sensing elements 58. The grinding sensing elements 58 are each respectively movable about pivot axes 68. A container 10 passing in the transport direction 32 deflects the grinding sensing elements 58 outwardly. This outward deflection acts against a defined deformation force 70, which is required for introducing the desired container deformation 62. Optionally, suitable rolling elements such as small rolls or the like may be arranged at the edges of the pivotal sensing elements 58, which are contacting the container wall. The rolling elements avoid damage or stress marks on the containers surface. Moreover, the movement of the containers 10 is delayed less compared to the use if rigid sensing elements 58.

Figure 8:
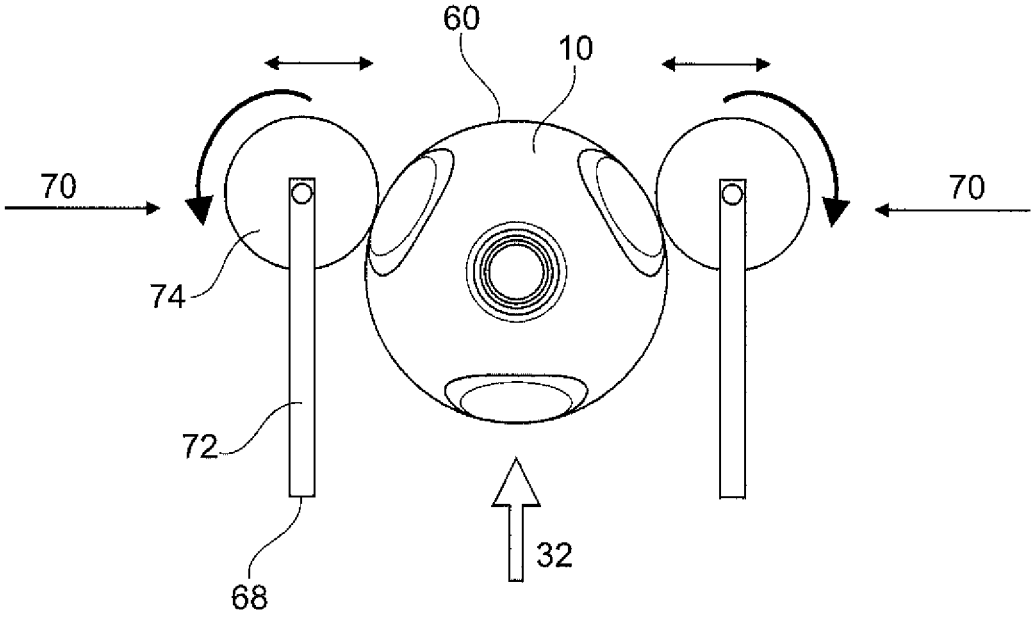
FIG. 8 shows a fourth embodiment of a mechanical measuring arrangement for the recordation of the container rigidity.

The top view of FIG. 8 shows a third embodiment of a mechanical measuring means with rolling sensing elements 58. The sensing elements 58 each comprise extension arms 72 with rotatable rollers 74, which can roll along the mantle surfaces 60 of the containers 10. The extension arms 72 are each movably mounted about a pivot axis 68. The extension arms 72, together with the rotatable rollers 74, are deflected outwards, when containers 10 are passing in transport direction 32. This outward deflection acts against a defined deformation force 70, which is required for introducing the desired container deformation 62.

Figure 9:
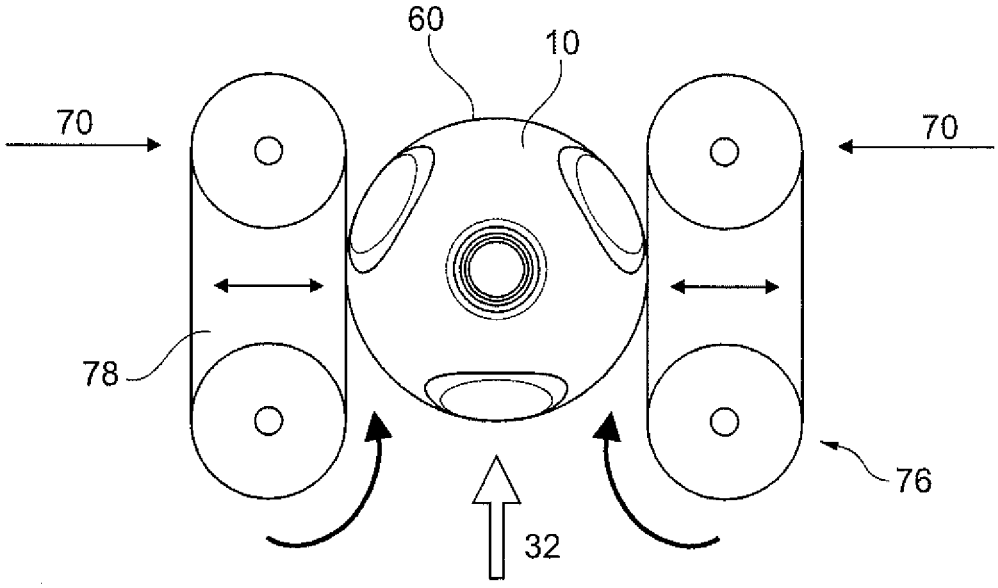
FIG. 9 shows a fifth embodiment of a mechanical measuring arrangement for the recordation of the container rigidity.

The top view of FIG. 9 shows a further embodiment with rolling sensing elements 58. The sensing elements 58 are each formed by a pair of rollers 76 with circumferential sensing ribbons 78. The sensing ribbons 78 are unrolling on the mantle surfaces of the containers 10 on both sides. The roller pairs 76 with the sensing ribbons 78 may, for example, be movable in opposite directions towards the container 10. Especially they can be moved towards each other and towards the container 10 with a defined deformation force 70, whereby they are each deflected outwards when a container 10 passes in transport direction 32.

In principle, non-cylindrical containers 10 and/or containers 10 with tapered or expanding diameters can be processed and scanned, using the arrangements described here. This is possible, because the sensing elements 58 are height adjustable and can be adjusted to the contour of the container, depending on their individual configuration. To obtain a correct evaluation value of the actual container rigidity, which takes into account the shape of the containers 10, it might be sensible to assess the measured values differently in the evaluation unit 44. The validity of the recorded measurement values can also be assessed by different experimental series. Therefore all kinds of shapes and contours of deformable containers can be processed with the described or similar methods.

FIG. 10 shows a schematic block diagram of a further alternative embodiment of a control circuit 50 for the adjustment of the strip tension of the strapping 12. The strip tension is adjusted during the ongoing process of the conveying and packaging plant 28. The adjustment is done via a respective control of the strapping heads 46 of the strapping station 34 during the application and fixation of the strapping strips 12 around the pack 14. In this third variation of a control circuit 50, which is shown in FIG. 10, the tension of the strapping strip is measured during its application to the pack 14. The deformational behavior of the containers 10 is not recorded. This is hereby referred to as measuring the strip tension or as a strip tension measurement or strip tension measuring means or measurer 80. This measurement can be performed by means of suitably mounted force measuring cells. Optionally the measurements are taken by optical methods, which detect a strip tension via the detection of material stretching properties. In this way the internal pressure of the containers 10 can be derived indirectly. Therefore this measuring method is equally suited for the optimization of the strip tension of the pack 14. The output signals 82 of the strip tension measuring means 80 are sent to the control and evaluation unit 44. The unit 44 then sends a control signal 54 to the back tensioning means 56 located in the region of the strapping head 46. The control signal 54 is used to regulate and adjust the tension of the strapping 12. The special feature of this measuring method is that the adjustment of the strip tension is done directly during the application of the strapping 12 on the pack 14. Therefore the adjustment of the pre-stressing force must also be done in a very short time. The regulation by the control circuit 50 must therefore show relatively short response and regulation times, to ensure the desired accurate adjustment of the pre-stress of the strapping 12 according to the particular requirements.

Figure 11:
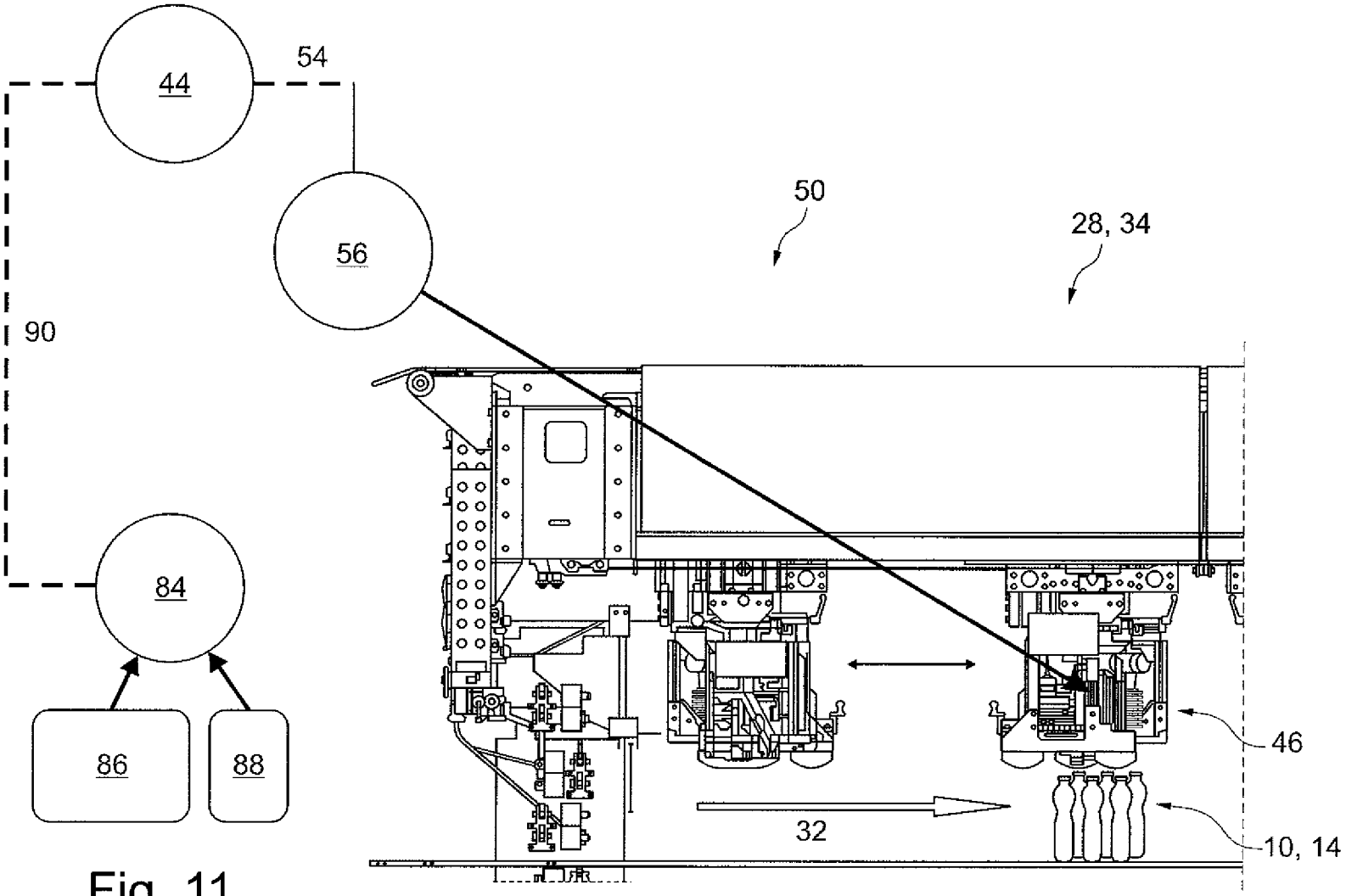
FIG. 11 shows a schematic view of a further regulatory arrangement for the control of a strapping device.

FIG. 11 shows an arrangement of a control circuit 50 in a schematic view. The shown control circuit 50 serves for the adjustment of the tensioning force of the strapping 12 by a strapping head 46 during an ongoing process, the strapping head 46 being part of a conveying and packaging plant 28. The tensioning force is varied by a respective control of the strapping heads 46 of the strapping station 34 during the application and fixation of the strapping strips 12. According to the fourth embodiment of the control circuit 50 shown in FIG. 11, recorded or already known properties of the article or container 10 and/or the used strapping material are used as control parameter for the tensioning force and/or back tensioning force. In the illustrated version of the control circuit 50, the product properties 84 are not determined by sensory means values 84. Instead they are processed otherwise, for instance with the help of an input terminal 86. Hereby the article parameters and/or article properties 84 are entered manually or machine-assisted. In addition, the necessary data can be determined with the help of bar code readers or other code readers, optical sensors or the like. The recorded data is then provided to the input terminal 86 and the initial values for a strip tension control are generated. Such a manual or machine-assisted initialization can be used sensibly, when different mechanical properties can be assigned to the different articles, which are to be strapped. The different mechanical properties are essentially already known. It is conceivable, for example, that a container color, a beverage color, a container shape, etc., each provides an input value for the initialization of the device for generating the tensioning force. The respective control data is preferably stored in a database 88. The output signals 90 of the mentioned means for the detection of the article properties 84 are send to the control and evaluation unit 44. For the regulation and adjustment of the pre-stress of the strapping 12, the unit 44 then sends a control signal 54 to the back tensioning means or tensioner 56, which is located in the region of the strapping head 46.

Figure 12:
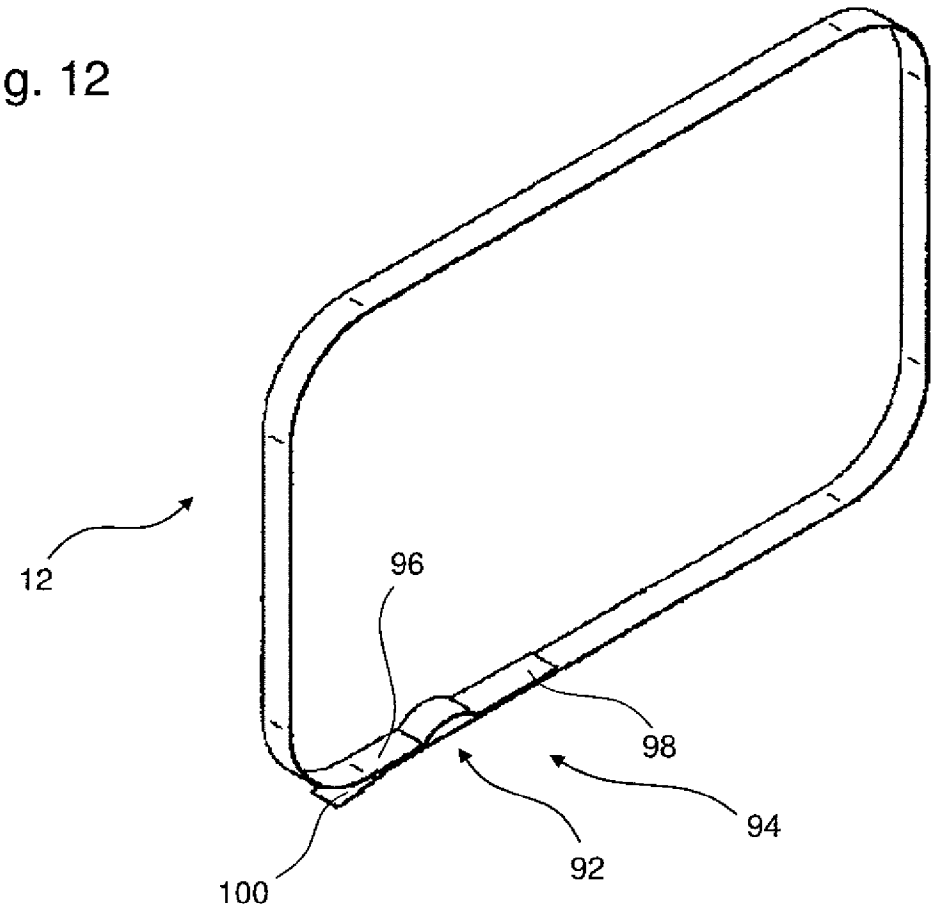
FIG. 12 shows an embodiment of a strapping strip for a pack according to FIG. 1.

The perspective view of FIG. 12 shows an embodiment of a strapping strip for a pack according to FIG. 1. A strapping strip 12 with a relief loop 92 or a so called compensator is shown. The relief loop 92 or compensator serves for reducing the tension forces during removal of the strapping 12 from the containers 10, especially during separation of the strapping 12 from the pack 14. The relief loop 92 or relief flap or compensator is usually formed at a contact spot 94. Instead of just one welding joint 18 as shown in FIG. 1, two joints 96 and 98 are provided at the contact spot 94, connecting the abutting or overlapping strip ends. The joints are especially welding joints. The two joints 96 and 98, connecting the overlapping ends of the strapping strip 12, are preferentially designed in such a way, that the strapping strip 12 between the two joints 96 and 98 does not rest flush, but is slightly longer on one side. Thereby a loop 92 is formed, whereby the two overlapping sections of the strapping 12 are slightly apart from each other. The strapping 12 can now be opened by removing one of the protruding ends 100. Thereby the first welding joint or connective joint 96 is broken first at the respective protruding end 100. This relaxes the defined pre-stress of the strapping 12 by a small amount. This amount is provided by the compensator or the relief loop 92. Subsequently the now slackened strapping 12 is completely opened by breaking open the second welding joint 98. Now the strapping 12 can be removed. According to the present invention the at least one strapping 12 is applied under a defined pre-stress. The removal of the strapping 12 is often associated with a sudden relaxation, which is perceived to be uncomfortable by many users. Especially since the sudden relaxation of the strapping 12 may lead to a whip-like removal of the strapping 12 from the pack 14. The embodiment of a relief loop 92 (compensator) according to FIG. 12 reliably prevents this.

The two connective joints 96 and 98 mentioned above are preferably designed as welding joints. The separation and opening of the first welding joint 96 preferentially requires only a small pulling force, meanwhile the separation and opening of the second welding joint 98 requires a larger pulling force. In this way, the connection at the contact spot 94 can be separated gradually. First the contact area at the first connective joint 96 is removed (see left side of FIG. 12). Thereby the relief loop 92 provides a reservoir of strapping strip 12 to reduce the pre-stress. By further pulling on the pulling loop 100, the second connective joint 98 is removed. Thereby the connection at the contact spot 94 is separated completely.

The protruding end 100 of the compensator of the strapping 12 forms a pulling handle. It may therefore be of advantage, if at least the connective joint 96 facing the protruding end 100 comprises a structured bonding and/or welding site (not shown here) to influence and/or facilitate the removal process. Thus, the welding or bonding at this connective joint 96 can show a suitable structure, interruptions and/or a suitable shape. Because of this suitable structure, the detachment force, which is required from the user for opening the strapping, is relatively small and largely uniform. The contact site or connective joint 96 can comprise a strip-like or parabola shaped bonding and/or welding. This bonding and/or welding is separated during the removal of the strapping 12, starting from the rounded apex and further continuing along the two flanks of the parabola. Other shapes are also possible and suitable, for instance a meandering course or a plurality of local bonding spots and/or welding spots spaced apart from each other.

The invention has been described with reference to preferred embodiments. In addition to the above-mentioned measuring methods and measuring systems, further variations are possible. The deformation of the containers can be recorded by contact-free measuring methods, like optical, inductive or capacitive measuring methods. To the expert it is also conceivable, however, to make changes and modifications without leaving the scope of protection of the appended claims. Ribbon and strip are used herein interchangeably.

LIST OF REFERENCE NUMBERS

10 container, PET-container
12 strapping strip, strapping
14 Pack
16 overlapping ends/ends of the strip
18 welding joint/welding connection
20 Constriction
22 bottle neck
24 top-side opening
26 carrying handle
28 conveying and packaging plant
30 Conveyor
32 transport direction

34 strapping station
36 grouping station
38 pack formation
40 further conveyor
42 optical measuring means
44 control and evaluation unit
46 strapping head
48 mechanical measuring means
50 control circuit
52 output signal
53 output signal
54 control signal
56 back tensioning means
58 sensing element
60 mantle surface, container mantle surface
62 deformation, deformation depth
64 support wall
66 height adjustment means
68 pivot axis
70 deformation force
72 extension arm
74 Roller
76 roller pair
78 sensing ribbon
80 strip tension measuring means
82 output signal
84 article properties
86 input terminal
88 Database
90 output signal
92 loop, relief loop
94 contact spot
96 connective joint, welding joint
98 connective joint, welding joint
100 protruding end, pulling loop

What is claimed is:

1. A device for manufacturing a pack comprising at least one article, comprising:

at least one strapper for applying a strapping around the at least one article, the strapping being a strip, the strapping being placed and/or strapped around the outside of the article horizontally and/or vertically and/or cross-wise;

a generator for generating a definable tensioning force of the strapping;

a detector for detection of properties of the article, the detector coupled and/or effectively connected to the generator; and a mechanical measurer for recordation of mechanical properties of the article; and wherein at least one of the recorded article parameters can be derived from a measured deformation of the article or container and/or from the recorded internal pressure of the article or container.

2. The device as recited in claim 1 further comprising a fixator for the fixation of ends of the strapping.

3. The device as recited in claim 1 further comprising a former for the formation of at least one loop, the loop being formed in at least one section of the connected strapping or in at least one section of the strapping to be connected.

4. The device as recited in claim 1 wherein the detector for the detection of properties of the article is located upstream of the strapper.

5. The device as recited in claim 1 wherein the mechanical properties include article parameters relating to the strength and/or filling level and/ or internal pressure of the article.

6. A method for manufacturing a pack comprising at least one article, with a strapping in the form of a strip placed and/or strapped around the outside of the article horizontally and/or vertically and/or cross-wise, comprising:

controlling and/or regulating a tensioning force of the strapping individually and variably depending on properties of the articles;

wherein the properties of the articles are measured and/or recorded mechanical properties of the articles; and wherein at least one of the recorded article parameters is derived from a detected deformation of the article or container and/or at least one of the recorded article parameters is derived from a detected internal pressure of the article or container.

7. The method as recited in claim 6 wherein the measured and/or recorded mechanical properties further include article parameters relating to article strength, and/or filling level.

8. The method as recited in claim 6 further comprising interconnecting ends of the strapping after the tensioning force of the strapping has been generated.

9. The method as recited in claim 6 wherein an internal pressure prevailing in the article or container and/or a deformation or a concave or convex curvature of at least one side wall of the article or container is detected or derived via an optical measurer.

10. The method as recited in claim 9 wherein a gaseous concentration is measured in a section of the article or container, the gaseous concentration being used to derive the internal pressure prevailing in the article or container.

11. The method as recited in claim 9 wherein the gaseous concentration is measured in the gaseous space located above a liquid filing level.

12. The method as recited in claim 6 wherein at least one of the recorded article parameters is derived from a strip tension recorded during wrapping and/or immediately prior to the fixation of the strip ends of the strapping.

13. The method as recited in claim 6 wherein at least one of the recorded article parameters is used as a control variable for a strip tension control.

14. A regulation and/or control method for a strapper, comprising:

using recorded properties of at least one article to be strapped and/or recorded properties of the strapping material to be used as control variables for a tensioning force and/or a back tensioning force, wherein the properties of the article are measured and/or recorded mechanical properties of the article including article parameters relating to article strength, filling level and/or internal pressure, wherein at least one of the recorded article parameters is derived from a detected deformation of the article or container and/or at least one of the recorded article parameters is derived from a detected internal pressure of the article or container.

15. The method as recited in claim 14 wherein the signals and/or values of a detector for detection of properties of the article to be strapped are used for generation of a setting value of the strapper.

16. A method for manufacturing a pack comprising at least one article, with a strapping in the form of a strip placed and/or strapped around the outside of the article horizontally and/or vertically and/or cross-wise, comprising:

controlling and/or regulating a tensioning force of the strapping individually and variably depending on properties of the articles, wherein the properties of the article are measured and/or recorded mechanical properties of the article including article parameters relating to article strength, filling level and/or internal pressure, wherein at least one of the recorded article parameters is derived from a detected deformation of the article or container and/or at least one of the recorded article parameters is derived from a detected internal pressure of the article or container.

* * * * *